US005377860A

United States Patent [19]

Littlejohn et al.

[11] Patent Number: 5,377,860

[45] Date of Patent: Jan. 3, 1995

[54] DOUBLE SEAL FOOD CONTAINER

[75] Inventors: Mark Littlejohn, Appleton; Michael P. Juneau, Neenah, both of Wis.

[73] Assignee: James River Corporation of Virginia, Richmond, Va.

[21] Appl. No.: 120,525

[22] Filed: Sep. 14, 1993

[51] Int. Cl.[6] ..... B65D 41/16

[52] U.S. Cl. ..... 220/306; 220/307; 220/4.21

[58] Field of Search ..... 220/4.21, 4.22, 4.23, 220/306, 307, 337, 339, 355; 206/45.32

[56] References Cited

U.S. PATENT DOCUMENTS

| | | | |
|---|---|---|---|
| 2,972,432 | 2/1961 | Flack et al. | 220/306 |
| 3,065,875 | 11/1962 | Negoro . | |
| 3,089,605 | 5/1963 | Buonauro . | |
| 3,091,360 | 5/1963 | Edwards . | |
| 3,101,864 | 8/1963 | Glickman . | |
| 3,131,827 | 5/1964 | Wheaton . | |
| 3,170,594 | 2/1965 | Nascher . | |
| 3,171,580 | 3/1965 | Davis et al. . | |
| 3,206,059 | 8/1965 | Fead et al. . | |
| 3,237,803 | 3/1966 | Edwards | 220/306 |
| 3,264,786 | 4/1966 | Holley . | |
| 3,320,993 | 5/1967 | Motsenbocker | 220/306 |
| 3,349,941 | 10/1967 | Wanderer | 220/307 |
| 3,351,227 | 11/1967 | Collie . | |
| 3,353,707 | 11/1967 | Eyles . | |
| 3,362,575 | 1/1968 | Fotos . | |
| 3,384,265 | 5/1968 | Frank . | |
| 3,448,888 | 6/1969 | Smith et al. . | |
| 3,452,896 | 7/1969 | Elliot . | |
| 3,460,711 | 8/1969 | Al-Roy | 220/307 |
| 3,520,441 | 7/1970 | Fitzgerald | 220/306 |
| 3,583,596 | 6/1971 | Brewer . | |
| 3,598,271 | 8/1971 | Holley . | |
| 3,615,039 | 10/1971 | Ward . | |
| 3,632,016 | 1/1972 | Bozek . | |
| 3,643,830 | 2/1972 | Kinney . | |
| 3,677,435 | 7/1972 | Davis | 220/307 |
| 3,721,367 | 3/1973 | Fletcher . | |
| 3,722,784 | 3/1973 | Harper . | |
| 3,730,382 | 5/1973 | Heisler . | |
| 3,737,093 | 6/1973 | Amberg et al. . | |
| 3,743,133 | 7/1973 | Rathbun | 220/306 |
| 3,744,663 | 7/1973 | Moren | 220/306 |
| 3,773,207 | 11/1973 | Dokoupil et al. . | |
| 3,779,418 | 12/1973 | Davis . | |

(List continued on next page.)

FOREIGN PATENT DOCUMENTS

| | | | |
|---|---|---|---|
| 619949 | 5/1961 | Canada | 220/306 |

*Primary Examiner*—David T. Fidei

*Attorney, Agent, or Firm*—Sixbey, Friedman, Leedom & Ferguson

[57] ABSTRACT

A food container which is a combination of a base portion and a lid portion made from a resilient polymeric material is disclosed. The base is a unitary component including an upwardly projecting, peripherally extending sealing rim having inner and outer sealing areas. The lid is also a unitary component including a peripherally extending sealing channel correspondingly shaped to receive the sealing rim of the base and particularly, to engage the rim at the inner and outer sealing areas. Because both the base and lid are made from resilient material, the inner and outer sealing areas are shaped to provide a self-reinforcing seal configuration wherein the initial engagement of either the inner or the outer seals urges the other seal into engagement. This feature also permits a wide tolerance to processing variations in the size of the lid and the base. The base portion of the food container of the present invention is also designed to include audible indicators as the lid becomes fully sealed with the base. Further, the container is suitable for microwave cooking.

55 Claims, 7 Drawing Sheets

U.S. PATENT DOCUMENTS

| | | | |
|---|---|---|---|
| 3,805,991 | 4/1974 | Cheladze et al. . | |
| 3,883,036 | 5/1975 | Mahaffy et al. . | |
| 3,912,118 | 10/1975 | Bird . | |
| 3,964,635 | 6/1976 | Ludder . | |
| 3,977,559 | 8/1976 | Lombardi . | |
| 3,977,563 | 8/1976 | Holt . | |
| 4,037,748 | 7/1977 | Stubbs, Jr. . | |
| 4,047,329 | 9/1977 | Holt . | |
| 4,194,645 | 3/1980 | Zabner et al. | 220/355 |
| 4,293,080 | 10/1981 | Letica . | |
| 4,351,447 | 9/1982 | Graff | 220/306 |
| 4,380,304 | 4/1983 | Anderson . | |
| 4,474,305 | 10/1984 | Marco | 220/307 |
| 4,555,043 | 11/1985 | Bernhardt | 220/306 |
| 4,555,056 | 11/1985 | Bernhardt | 220/306 |
| 4,721,210 | 1/1988 | Lawrence et al. | 220/306 |
| 4,741,452 | 3/1988 | Holzkopf | 206/45.32 |
| 4,742,934 | 5/1988 | Michaud et al. | 220/306 |
| 4,819,824 | 4/1989 | Longbottom et al. | 220/306 |
| 4,836,407 | 6/1989 | Bruce et al. | 220/307 |
| 4,886,184 | 12/1989 | Chamourian | 220/306 |
| 4,976,370 | 12/1990 | Cassel | 220/306 |
| 5,092,479 | 3/1992 | Wells | 220/4.23 |
| 5,129,517 | 7/1992 | Hustad | 220/307 |
| 5,269,430 | 12/1993 | Schlaupitz et al. | 220/4.23 |

DOUBLE SEAL FOOD CONTAINER

BACKGROUND OF THE INVENTION

1. Technical Field of the Invention

This invention generally relates to a container useful for storing and transporting food and specifically, to a container including a base portion and a lid portion formed to include a double seal which adjusts for variations in the size of the base portion or the lid portion.

2. Description of the Background Art

Convenience is essential for modem food packaging. Packaging which requires care or special attention will normally fail in the market while it seems that products succeed only when they are not only low in cost, but also extremely simple and easy to use. Even though the microwave oven has made cooking, or more specifically heating, of foods far quicker and more convenient, still simpler, more convenient and lower cost containers are needed. In addition, more establishments have recently begun offering foods on a carry-out basis which are substantially ready for consumption but are meant to be taken home and, possibly, reheated in the microwave oven by the consumer. Containers for this market should be attractive, low in cost, easy to seal, easy to open, easy to reseal, stackable and storable in the lowest possible volume. Most importantly, they must be low in cost and easy for customers to use.

One significant feature important to consumers with regard to containers is providing an appropriate seal between the lid of the container and the base. U.S. Pat. No. 3,964,635, issued to Ludder discloses a recess, rim-locking container closure for attachment to a wide-mouth container. The lid includes an annular portion fitting over a portion of the container. Specifically, the container is required to include a curled rim or bead surrounding the open mouth thereof. The rim of the container does not extend downwardly and outwardly below the lower extent of the lid which requires the lid and base to be molded to very close tolerances. Moreover, the lid is formed in a "female mold" and clearly does not include formation by a "male mold" which is generally more efficient.

U.S. Pat. No. 3,805,991 to Cheladze et al. is also directed to a lid having a rim structure which includes an annular, channel-shaped region for engaging a rim of a container. However, again the container does not include a matingly shaped rim to engage the annular sealing region of the lid to provide a superior "dual" sealing area and to allow for variations in the size of the lid or container while still providing an adequate seal. Additional U.S. Pat. Nos. to Negoro (3,065,875); Holt (3,977,563); Stubbs, Jr. (4,037,748); Letica (4,293,080); and Anderson (4,380,304) each disclose examples of snap-on lids and containers. However, each of these lids include substantial undercuts required to provide the seal between the lid and the container, but which also increase the amount of force required to open and close the containers.

Attempts have been made to relax the undercuts needed to produce a seal between the container and the lid, such as U.S. Pat. Nos. to Collie (3,351,227); Fotos (3,362,575); and Davis (3,779,418). Each of these patents disclose lids having more relaxed undercuts, but in many cases, if the undercuts are relaxed without any modification of the container, an adequate seal is not provided. This can be especially detrimental for containers used for transporting and storing food products.

Many food products release considerable amounts of steam during cooking so a strong seal between the lid and the container is very important to guard against leakage of hot contents onto the hands of the person removing the container from the oven.

In addition to the importance of a lidded container providing a reliable seal, the container and lid should also be conveniently manipulated to serve many purposes. Containers have been designed wherein the base or container is insertable into a portion of the lid to provide a stacking feature. U.S. Pat. Nos. to Bird (3,912,118); Holt (4,047,329); Fotos (3,362,575); Holley (3,246,786); and Buonauro (3,089,605) each disclose a base to lid stacking arrangement. However, each of the containers disclosed in these patents do not include a substantially fiat base, and all but the '329 patent include downwardly extending rims to raise the base of the container off of the ground. Such an arrangement can cause instability between the base and the lid because only a limited portion of the base is in actual contact with the lid.

Another useful feature for a lidded container are audible engaging members which provide the user with a positive indication when the lid and base are in sealing engagement. U.S. Pat. No. 3,452,896 to Elliot discloses a container which audibly indicates of when the lid is in place on the container. Further, U.S. Pat. No. 3,912,118 to Bird discloses a container lid having holes provided in the lid to release steam from the interior of the container wherein the holes are provided in bosses projecting into the container so that the lid may also be used as a server for the food without permitting grease to run through the holes. These patents do not, however, disclose containers with a self compensating double seal.

An additional feature which is useful for any mass produced and stored container are denesting lugs. U.S. Pat. No. 3,615,039 to Ward illustrates denesting lugs having different configurations on opposing end panels. A number of references disclose interlocking prevention detents of various shapes, e.g. U.S. Pat. Nos. to Edwards (3,091,360); Nascher (3,170,594); Eyles (3,353,707); Bozek (3,632,016); Fletcher (3,721,367); and Mahaffy et al. (3,883,036).

Containers having a lid and a base portion also often include tabs for assisting in the removal of the lid from the base. In some instances, one of the tabs is made longer than the other to ease separation therebetween. U.S. Pat. No. 3,737,093 to Amberg et al. discloses a multi-wall container and package which includes a pair of tab extensions on the container closure and the container body, respectively, wherein the closure tab may be longer than the tab of the container body to permit separation by the user. The container disclosed by Amberg et al. is not directed to a food container having a self compensating double seal.

Therefore, a food container which is attractive, low in cost, easy to seal, easy to open, easy to reseal, stackable and storable in a minimal space is needed. Specifically, a food container including a base and lid portion made from a resilient, low cost material and including an effective seal region is needed to provide mass market food distributors with a cost effective container that also satisfies a consumer's desire for a structurally sound and reliable storing and cooking food container.

SUMMARY OF THE INVENTION

Therefore, a primary object of the present invention is to overcome the deficiencies of the prior art, as described above, and specifically, to provide a food container having a base portion and a lid portion including a positive seal which is easy to open and close.

Another object of the present invention is to provide a food container made from a resilient, low cost material.

Yet another object of the present invention is to provide a food container including a self-reinforcing seal region which provides contact sealing around both the interior periphery of the base portion and the exterior periphery of the sealing region.

Still another object of the present invention is to provide a food container including a base portion and a lid portion which include alignment surfaces which tend to guide sealing areas into alignment with one another.

Another object of the present invention is to provide a reliable seal between the base portion and lid portion even though either the base portion, or lid portion or both are not produced to the exact size desired.

Yet another object of the present invention is to provide a food container including a base portion and a lid portion including minimal undercuts which reduce the force required to bring sealing areas into close engagement and permit a minimal stack height for the base and the lid.

Still another object of the present invention is to provide a food container which includes both inner and outer undercut portions for providing a positive indication as the lid portion becomes fully sealed with the base portion.

Yet another object of the present invention is to provide a food container which is attractive, low in cost, easy to seal, easy to open, easy to reseal, stackable and storable in a minimal space by selecting appropriate microwave-stable materials having resilient characteristics within a predetermined range and forming the container in a configuration within predetermined dimensional parameters to obtain the above noted qualities. Ideally such containers will also be microwaveable.

The foregoing objects are achieved by providing a food container useful for microwave cooking which is a combination of a base portion and a lid portion made from a resilient polymeric material. The base is a unitary component including an upwardly projecting, peripherally extending sealing rim having inner and outer sealing areas. The lid is also a unitary component including a peripherally extending sealing channel correspondingly shaped to receive the sealing rim of the base and particularly, to engage the rim at the inner and outer sealing areas. Because both the base and lid are made from resilient material, the inner and outer sealing areas are shaped to provide a self-reinforcing seal configuration wherein the initial engagement of either the inner or the outer seals urges the other seal into engagement. This feature also permits a wide tolerance to processing variations in the size of the lid and the base. The base portion of the food container of the present invention is also designed to include audible indicators as the lid becomes fully sealed with the base. The food container of the present invention can be rapidly and economically thermo-formed from sheets of low cost polymeric materials and includes a combination of features to provide consumers with a container which is easy to open and close with limited effort and which can be stored in bulk without requiting large amounts of storage space.

The materials from which the container may be made includes but is not limited to thermoplastic resins such as styrenics, polyolefins, polyesters, polyamides, polyarylates, polysulfones, polyetherketones, polycarbonates, acrylics, polyphenylene sulfides, liquid crystal polymers, acetals, cellulosics, polyetherimides, polyphenylene ethers/oxides, styrene maleic anhydride copolymers, styrene acrylonitrile copolymers, polyvinylchlorides and the like as well as engineered resin derivatives of the foregoing materials.

The various features, objects and advantages of the present invention will become apparent from the following Brief Description of the Drawings and Detailed Description of the Invention.

DETAILED DESCRIPTION OF THE INVENTION

Figure 1:
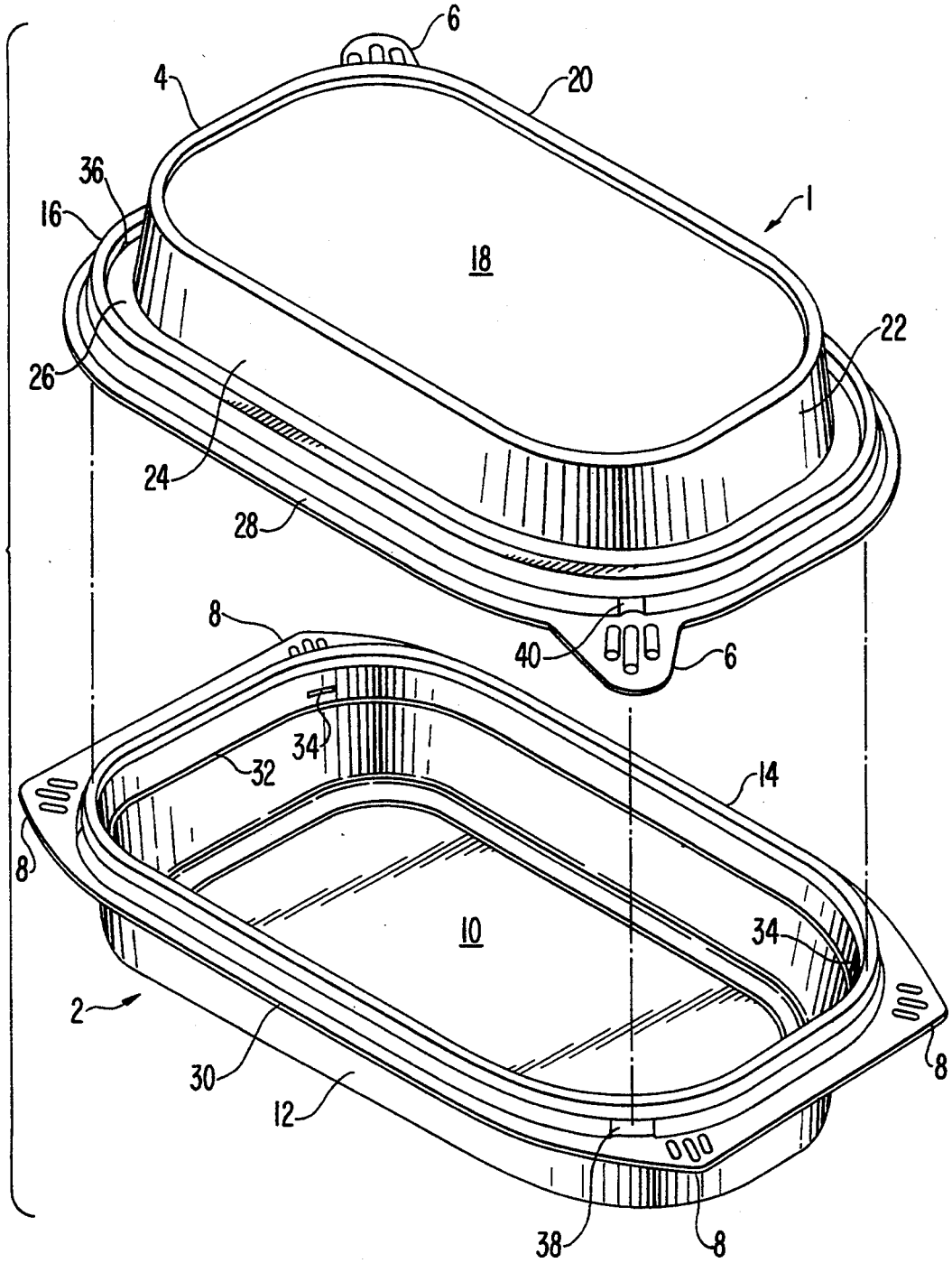
FIG. 1 is a perspective view of the lid and base of the present invention wherein the lid is separate from the base.

The invention will now be described in general with respect to FIG. 1 wherein the lid and base formed in accordance with the present invention is illustrated. While that container illustrated in FIG. 1 is oblong in configuration, the container may be round, oval, substantially rectangular or square as dictated by the contents which are to be placed within the container. The container 1 is formed of a base or bottom portion 2 and a lid 4. The lid 4 includes radially extending opening tabs 6 which cooperate with the radially extending opening tabs 8 of the base 2 in order to allow the consumer to readily open the sealed container. The significance of the configuration of these opening tabs will be discussed in greater detail hereinbelow.

The base 2 of the container 1 includes a substantially planar bottom 10 and a substantially vertically extending peripheral sidewall 12. Integrally connected to the upstanding sidewall 12 is a sealing brim 14 which is received within a cooperating sealing brim 16 of the lid 4. The particular configuration of the sealing brims 14 and 16 as well as their cooperation with one another will be described in greater detail hereinbelow.

Figure 14:
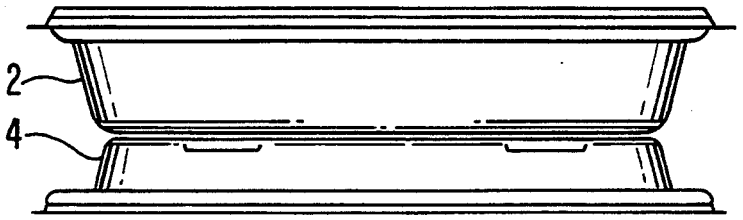
FIG. 14 is a side view of the lid and the base of the present invention inverted to illustrate a stacking feature thereof.

The lid 4 includes a substantially planar top portion 18 and a rim 20 extending about a periphery of the top portion 18. The rim 20 is provided in order to enhance the strength of an extended volume portion 22 of the lid 4. The rim 20 also serves to locate the base 2 on the lid when the lid is used as a stand as illustrated in FIG. 14.

The extended volume portion 22 is formed by extension wall 24 positioned about the perimeter of the rim 20 and extending downwardly therefrom. The extension wall 24 is integrally formed with a horizontal lid reinforcing ring 26 which is substantially parallel to the top portion 18 of the lid 4. The outer perimeter of the lid reinforcing ring 26 is further integrally formed with the sealing brim 16. Also, extending radially outward from the sealing brim 16 is a second horizontal lid reinforcing ring 28 which extends substantially parallel to the top portion 18 as well.

Figure 16:
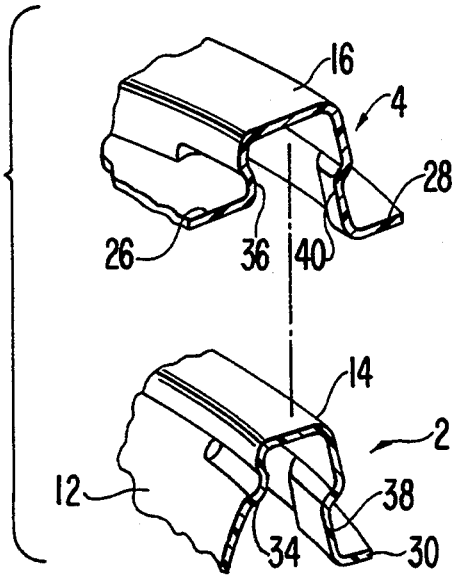
FIG. 16 is an exploded cut-away perspective view of the container illustrated in FIG. 15.

Similarly, the base 2 includes a horizontal lid reinforcing ring 30 which extends from the periphery of the sealing brim 14 for aiding in and maintaining the structural integrity of the sealing brim 14 as well as the container 1 as a whole. In addition to the reinforcing ring 30, a step 32 may be provided about an upper portion of the peripheral sidewall 12 for preventing nested units from becoming jammed together due to excessive interpenetration when stacked and nested. Also, formed in an upper portion of the sidewall 12 are undercuts 34 which cooperate with detents 36, only one of which is illustrated in FIG. 1 at the integral connection between a brim 16 and lid reinforcing ring 26. The detents when engaged in the undercuts 34, provide an audible indication that the container is in fact sealed. Additionally, undercuts 38 may be provided in an outer periphery of the brim 14 for receiving detents 40 formed in an outer portion of the brim 16 for again providing an audible indication that the container is sealed. While the container illustrated in FIG. 1 shows detents and undercuts formed in both the inner and outer portions of the brims 14 and 16, respectively, it may be desired to provide respective detents and undercuts on only one side of the brim or to provide no undercuts and detents on either side of the brim. However, in accordance with a preferred embodiment of the present invention, detents and undercuts are provided at each corner of an oblong shaped container. It should be noted herein that any number of mutually spaced pairs of detents and undercuts may be provided. The particular cooperation of the detents and undercuts will be explained in greater detail hereinbelow with respect to FIG. 16.

The particular configuration of the base portion 2 will now be described in greater detail with respect to FIGS. 2 and 3. As mentioned previously, the base 2 includes a substantially planar bottom 10 and an upwardly extending sidewall 12 which may taper slightly outwardly. Integrally formed with the sidewall 12 is the sealing brim 14. The particular components of the sealing brim will be discussed in greater detail with respect to the exploded section views of FIGS. 7–10 hereinbelow. It can be noted, however, that the sealing brim 14 includes the reinforcing ring 30 which extends substantially parallel to the bottom 10 of the base 2 with the reinforcing ring 30 including the opening tabs 8 thereabout. Further, the sealing brim portion 14 of the base 2 includes inner and outer undercuts of which only the inner undercuts 34 are shown. With the preferred embodiment, the undercuts 34 and 38 are provided on substantially the same horizontal plane, however, such positioning is not necessary for the proper functionality of the audible seal indicating means. The base portion 2 illustrated in FIG. 2 further includes staggered denesting lugs 39 which prevent the brims of successively stacked base portions 2 from interlocking with one another as interlocking can hinder removal of the uppermost base from a stack. Typically, these containers are manufactured from a master mold having cavities formed therein for at least six containers. Accordingly, each of the six cavities will have the position of the denesting lug forming portion of the mold varied so that no two containers formed during a single molding process which are to be stacked adjacent one another will have their denesting lugs 39 formed in the identical spots. Thus, the denesting lugs are formed in a staggered, mold design such that adjacent base portions 2 provided in a stack will not align with one another which would otherwise possibly result in the locking of adjacent base portions together.

Figure 2:
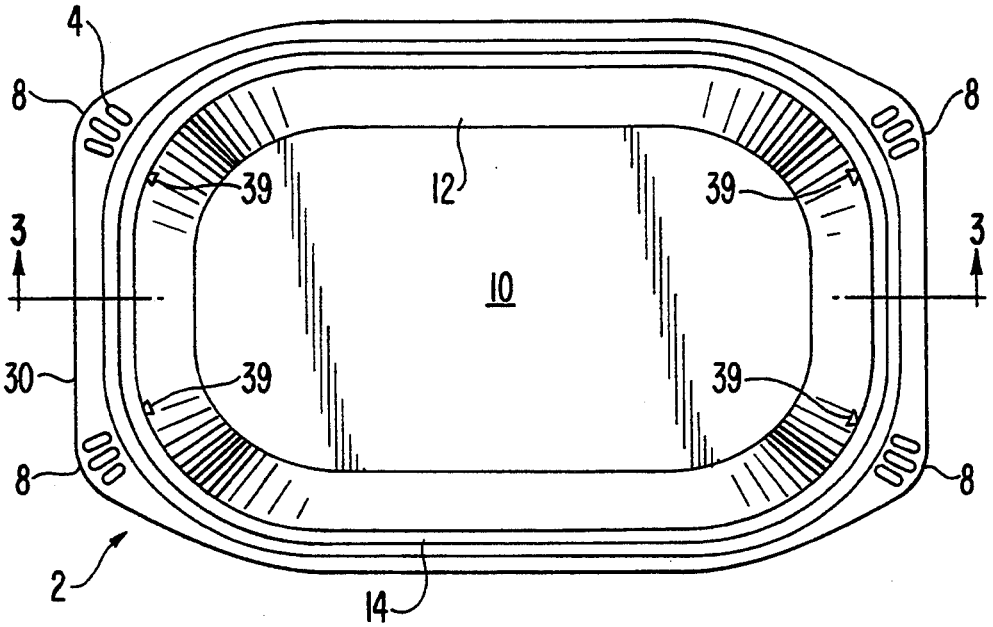
FIG. 2 is an elevated top view of the base of the present invention.
Figure 3:
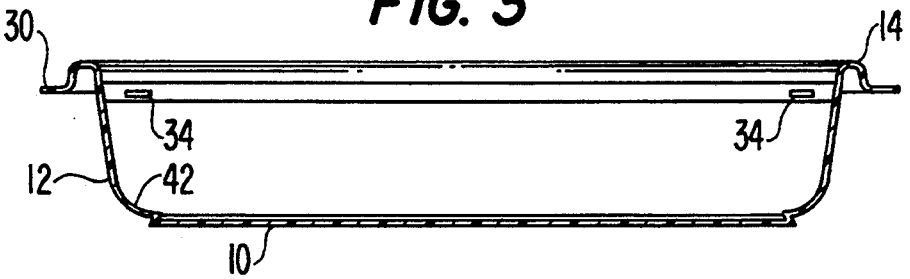
FIG. 3 is cross-sectional view of the base taken along line 3—3 of FIG. 2.

It can also be readily noted from FIG. 2 that the opening tabs 8 include reinforcing ribs 41 for stiffening the opening tabs for aiding the consumer in opening a sealed container. Further, it can be noted that the base 10 is stepped outwardly from the arched portion 42 of the sidewalls 12 so as to aid in the structural integrity of the overall container configuration and such that the bottom 10 of the container can be received in a recess formed by the rim 20 in the lid 4 when using the lid 4 as a stand for the base portion of the container. This feature being illustrated in FIG. 14.

Both the base 2 and the lid 4 which form the container may be injection molded, extruded and thermoformed or molded by any known means from thermoplastic resins including but not limited to styrenics, polyolefins, polyesters, polyamides, polyarylates, polysulfones, polyetherketones, polycarbonates, acrylics, polyethylene sulfides, liquid crystal polymers, acetals, cellulosics, polyetherimides, polyethylene ethers/oxides, styrenic maleic anhydride copolymers, styrene acrylonitrile copolymers, polyvinylchlorides and the like including all engineered resin derivatives of the foregoing. These materials may be oriented and/or foamed in order to add to the strength and toughness of the resultant container and so as to provide the maximum container strength with minimum thickness in order to reduce the overall cost of each respective container as well as the effective stack height of a stack formed of a plurality of the base portions 2 or lids 4.

Figure 4:
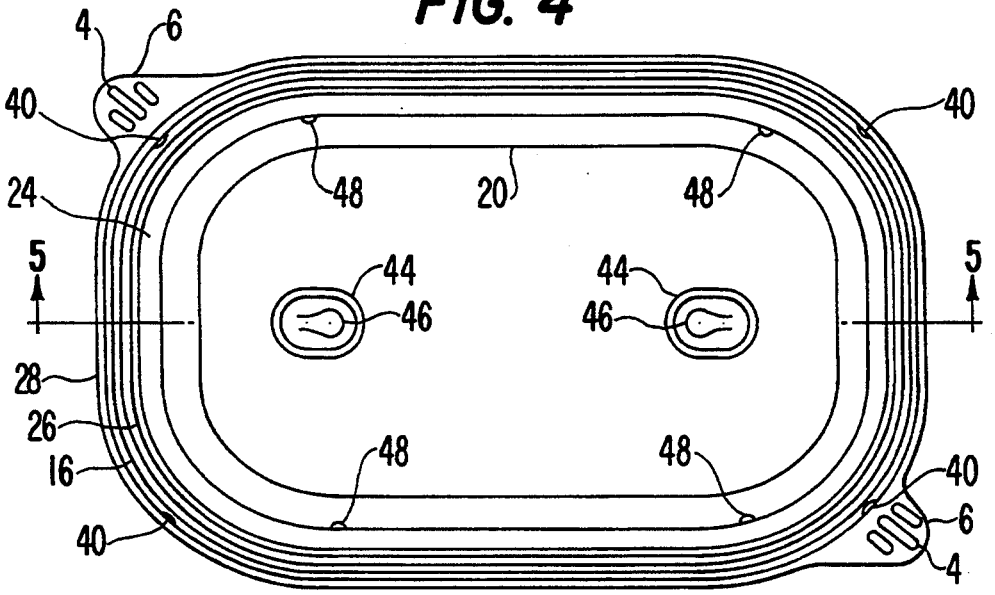
FIG. 4 is an elevated top view of the lid of the present invention.
Figure 5:
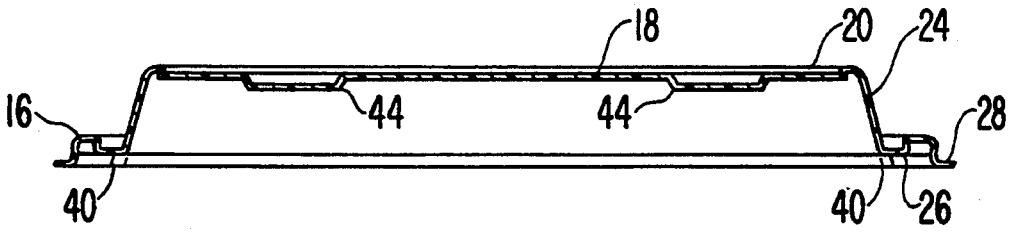
FIG. 5 is a cross-sectional view of the lid taken along line 5—5 of FIG. 4.
Figure 6:
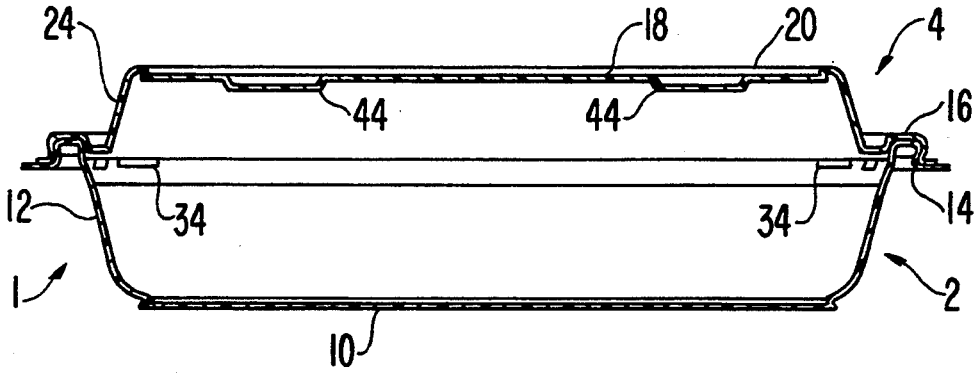
FIG. 6 is a cross-sectional side view of the lid engaged with the base in accordance with the present invention.

Referring now to FIGS. 4, 5 and 6, the lid 4 as well as the placement of the lid 4 on the base 2 will be described in detail. As is readily apparent from FIG. 4, the lid 4 includes the lid reinforcing ring 28 which is integrally connected to the sealing brim 16 which is in turn integrally connected to the reinforcing ring 26 which is integrally connected with the rim 20 by way of the extension wall 24. The top portion 18 of the lid is slightly recessed below the upper extremity of the rim 20. Also, as can be seen from FIGS. 4 and 5, the lid may include wells 44 formed in the top portion 18 as well as vents 46 which in the preferred embodiment are tear drop like configured slits formed in the lowermost extremity of the well. The wells make it possible to retain small amounts of liquid inside the container without fear of the liquid leaking from the container should the container accidentally be turned upside down. The vents also relieve pressure from within the container when placing the lid on the container and when heating the contents of the container in a microwave oven.

As with the base 2, the lid 4 includes denesting lugs 48 which, similarly to denesting lugs 39 in base portion 2, are variously spaced about the periphery of the rim 20 which like the base portion prevents the brim portion 16 of adjacent lids placed in a stack one upon the other from interlocking with one another which would otherwise prevent the easy removal of the uppermost lid from the stack of lids. Further, the lids 4 include detents 40 which are positioned to engage undercuts 36 formed in the base 2 which permits the user to be able to confirm easily and quickly whether the lid has been completely engaged against the base. The detents engage their respective undercut which results in a distinct snapping or thud sound as each of the four corners of the container are pressed into complete engagement. As mentioned previously, in the case where it is desired to provide a louder snap or thud or where softer materials are used, a double detent design is used, where detents are provided in both the inside and outside sealing surfaces of the brims. Such an expedient will assure the sealing of the container.

With respect to FIG. 6, it is readily apparent that when the lid 4 is placed on the base 2, their respective brims cooperate with one another in order to form what is preferably a substantially continuous seal about the interconnection between the two members. More particularly, a substantially continuous seal may be formed about the contact surface between the inner portions of the brims and/or the contact surfaces between the outer portions of the brims. This feature will be explained in greater detail hereinbelow with respect to FIGS. 7–10.

Figure 10:
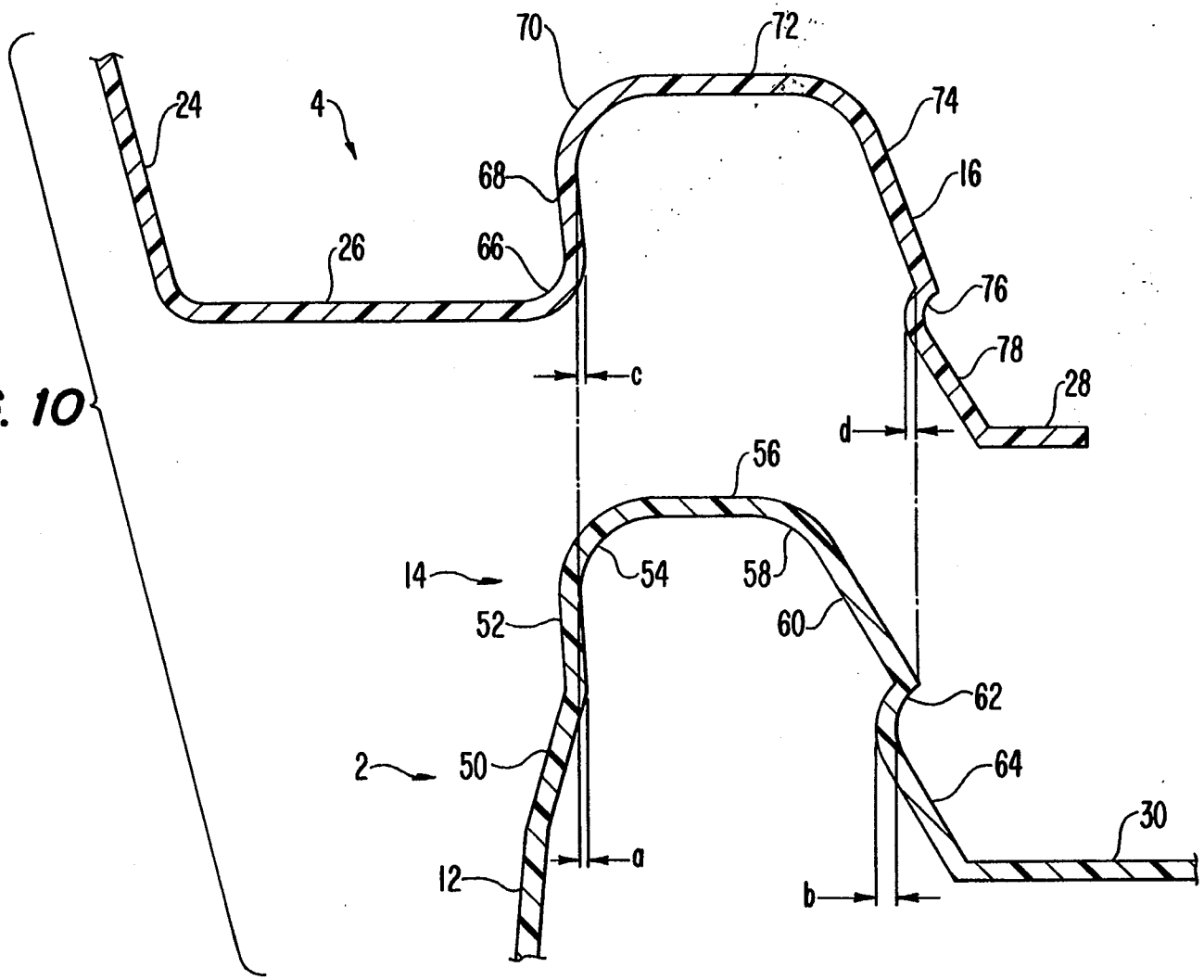
FIG. 10 is a detailed cross-sectional side view of the dimensions of the undercuts of both the lid and base which attribute to the advantageous stacking feature of the present invention.

Referring now to FIG. 10 wherein the base 2 and lid 4 are illustrated in partial cross sectional view, the base 2 includes the upstanding sidewall 12 which is integrally connected to the brim 14. The brim 14 is formed by a number of integrally formed and cooperating parts. The first of which is an upwardly extending peripheral base reinforcing hoop 50 which is integrally connected to the sidewall 12. As can be seen from FIG. 10, the base reinforcing hoop 50 is angled slightly outwardly in order to add strength to the brim 14. Integrally connected to the base reinforcing hoop 50 is an inwardly and upwardly tapering frusto-conical base seal area 52 which as with the base reinforcing hoop extends continuously about the perimeter of the base 12. As is illustrated in FIG. 10, the base seal area 52 is tapered inwardly a distance "a" which results in an included angle of a cone formed by the frusto-conical base sealing area extending at an angle of less than about 20°. Integrally connected to an uppermost end of the base sealed area 52 is an upwardly and outwardly flared first base alignment surface 54 which extends to a resilient base realignment surface 56. A second flared base alignment surface 58 is provided between the resilient base alignment surface 56 and a downwardly and outwardly extending surface 60. An undercut secondary sealing ridge 62 is formed in the outermost extremity of the surface 60 with the undercut being recessed inwardly a predetermined distance "b". In order to further aid in the structural integrity of the brim 14, a downwardly and outwardly flared peripheral base reinforcing hoop 64 is provided between the undercut secondary seal ridge 62 and the reinforcing ring 30.

Similarly, the lid 4 includes the extension wall 24 which is integrally connected to the lid reinforcing ring 26 which is subsequently integrally connected to the brim 16. The brim 16 is composed of an upwardly and outwardly flared first lid alignment surface 66 which is subsequently integrally connected to an inwardly and upwardly tapering frusto-conical lid seal area 68. As with the frusto-conical base seal area 52, the frusto-conical lid seal area 68 is angled inwardly at an angle less than about 20° with the upper portion of the frusto-conical lid seal area being tapered inwardly a distance "c" which is greater than the distance "a" in which the frusto-conical base seal area 52 is tapered inwardly. The significance of which will be described in greater detail hereinbelow.

The frusto-conical lid seal area is thus integrally formed with an upwardly and outwardly flaring wall portion 70 which is subsequently integrally formed with a resilient lid realignment surface 72. Extending downwardly and outwardly from the resilient lid realignment surface 72 is a flaring lid reinforcing hoop 74 which extends downwardly to a secondary lid seal furrow 76 which cooperates with the secondary sealing ridge 62 thereby forming a secondary seal between the lid and bases. The secondary lid sealing furrow 76 is recessed a distance "d" which as can be seen from FIG. 10 is less than the recessed distance "b" of the secondary seal ridge 62. Further, the lid reinforcing ring 28 is integrally connected to the secondary lid seal furrow 76 by way of a downwardly and outwardly flaring lid alignment surface 78. As will be discussed in greater detail hereinbelow, the components forming both the brim of the base as well as the brim for the lid, cooperate with one another in order to form a reliable seal about the periphery of the container.

Figure 7:
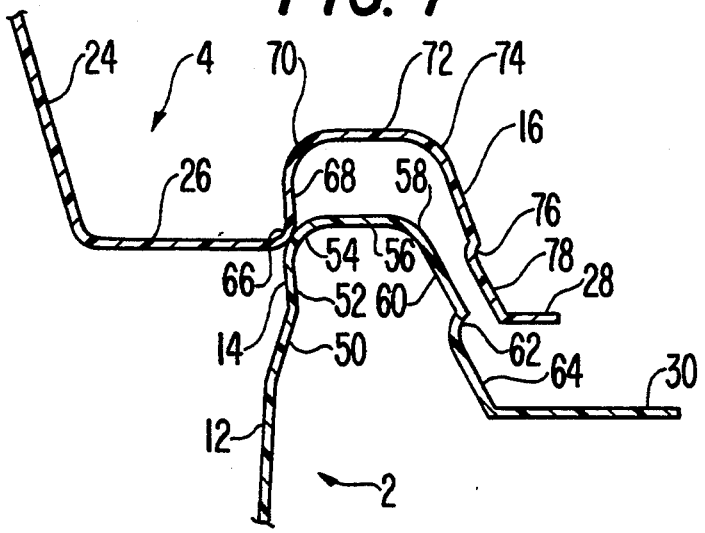
FIGS. 7–9 are detailed cross-sectional side views of the sealing portions of the lid and the base of the present invention before, during and after the components have been placed in sealing engagement, respectively.
Figure 8:
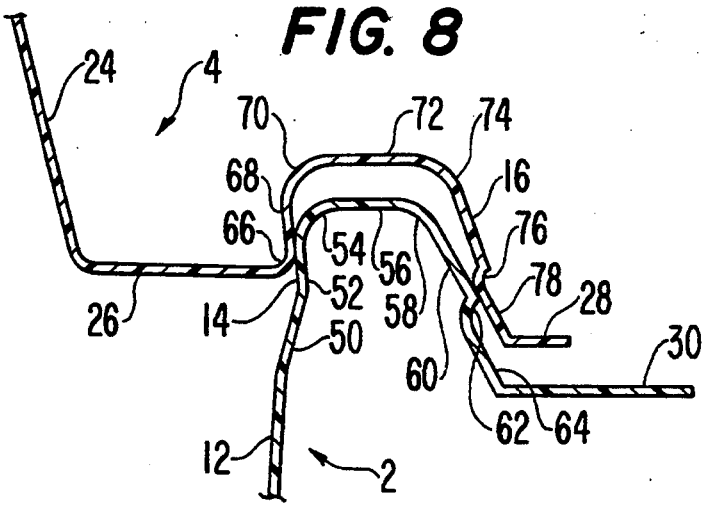
Figure 9:
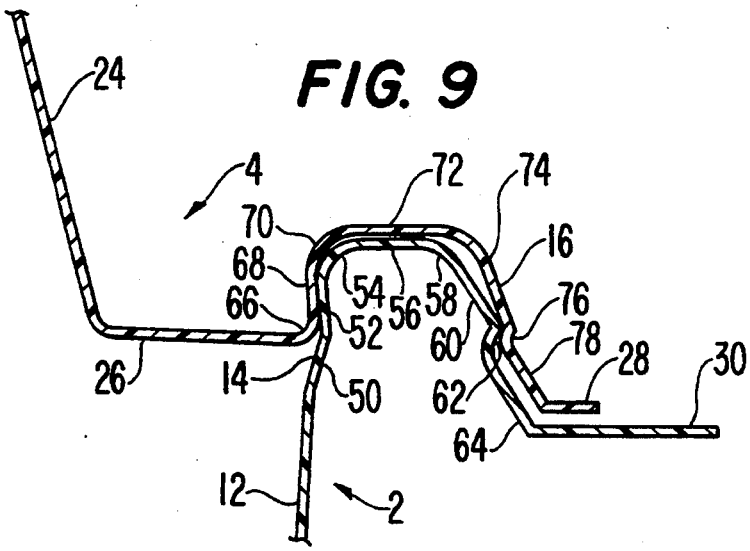

Referring now to FIGS. 7–9, the cooperation between the various components forming the respective brims are illustrated in detail. Initially, as is illustrated in FIG. 7, the flared first lid alignment surface 66 contacts the upwardly and outwardly flaring first base alignment surface 54 which squarely positions the lid with respect to the base about the entire periphery of the lid. Continued downward movement of the lid with respect to the base, places the second flaring lid alignment surface 78 into contact with the downwardly and outwardly flaring alignment surface 60 of the base 2, as is clearly illustrated in FIG. 8. Once in this position, continued downward movement of the lid with respect to the base causes the brim 14 to flex inwardly and the brim 16 to flex outwardly. Thus, the base realignment surface 56 and the lid realignment surface 72 flex in order to maintain alignment of the lid with respect to the base.

Further, downward movement of the lid 4 with respect to the base 2 causes the tapering frusto-conical lid seal area 68 to come into contact with the tapering frusto-conical base seal area 52 and the secondary lid seal furrow 76 to be engaged with the secondary seal ridge 62. Accordingly, by proper selection of dimensions, "a", "b", "c" and "d" referred to hereinabove, with respect to FIG. 10, a seal is provided both between the frusto-conical lid seal area 68 and the frusto-conical base seal area 52 as well as between the secondary lid seal furrow 76 and the secondary seal ridge 62 as illustrated in FIG. 9. Accordingly, a dual seal is achieved between the base 2 and the lid 4. Further, with the flexing of the resilient lid realignment surface 72 and the resilient base realignment surface 56, each of the surfaces act to urge the sealing components of the brims into contact with one another.

Due to the interaction of numerous variables during the formation of the base and lid components which are difficult to control within a predetermined tolerance, the lid and base do not always achieve the precise size desired. Accordingly, because the seal formed between the base and lid in accordance with the present invention is a flexible dual seal, even with substantial sizing variation between the lid and base, an adequate seal will always be provided therebetween. In the case where the base and lid have nominal sizing or both vary from nominal sizing in the same amounts and in the same direction, i.e., with both being either slightly over or slightly under the nominal sizing, the lid and base portion will seal along the area extending around the inside periphery of the sealing brim 14 and the inside periphery of sealing brim 16. Further, as discussed hereinabove, a secondary seal along the line around the exterior periphery of the sealing brim 14 and the outside periphery of the sealing brim 16 at the location formed by the secondary sealed ridge 62 and the secondary seal furrow 76 is also accomplished.

In the case where the base portion 2 may be manufactured slightly smaller than a nominal size relative to the lid, a leak resistant seal will be achieved at least between the inside periphery of the sealing brim 14 and the inside periphery of the sealing brim 16 due to the flexure of the resilient base realignment surface 56 and the resilient lid realignment surface 72 as well as the interaction between the frusto-conical base seal area 52 and the frusto-conical lid seal area 68. Similarly, in the case where the base portion 2 is relatively large when compared to the lid 4, a reliable seal is formed at least in the area between the secondary seal ridge 62 of the base 2 and the secondary seal furrow 76 of the lid 4. Consequently, it is clear that effective and reliable seals are formed over a relatively wide range of possible size variations which may occur during the manufacturer of the lid and base portions. Consequently, it is not necessary to maintain overly strict tolerance during the manufacturing process allowing a decrease in the overall cost of the container.

Figure 11:
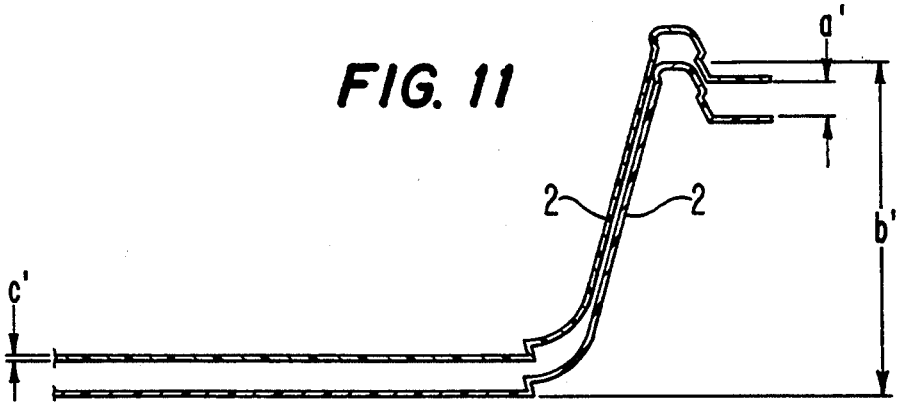
FIG. 11 is a detailed cross-sectional side view of stacked bases made in accordance with the present invention.
Figure 12:
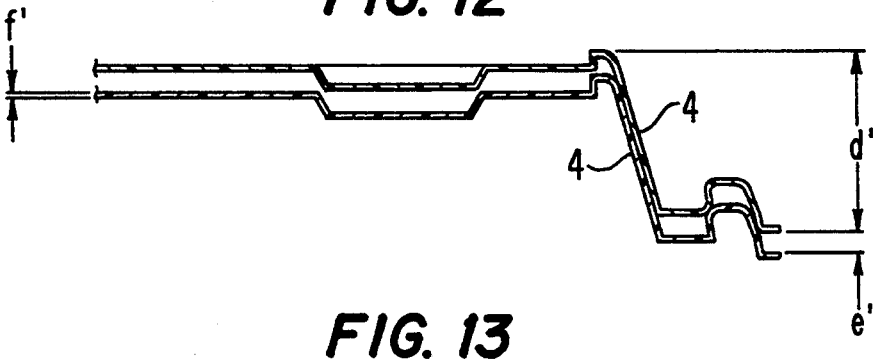
FIG. 12 is a detailed cross-sectional side view of stacked lids made in accordance with the present invention.

Referring now to FIGS. 11 and 12, as can be seen therein, both the lids 4 and base portions 2 can be easily stacked in nested columns, lid upon lid and base upon base. Further, the base 2 is formed having a relatively low channel height such that the stacking height may be maintained at a minimal amount. That is, as can be seen from FIG. 11, each successive base portion 2 which is placed one upon the other adds a distance "a'" to the stacking height of the stack. Accordingly, by maintaining a minimal thickness of the material, that is thickness "c'" even with a substantial profile "b'" of the base 2, the stacking height can thus be maintained at a minimal amount. Similarly, with respect to the lids, each lid which is stacked one upon the other adds only the dimension "e'" to the overall stacking height despite the thickness "f'" of the material and a substantial overall profile "d'" of the lid 4. In doing so, a minimal stack height will be achieved for a large number of container components. Further, as discussed hereinabove, each of the base portions 2 and lids 4 include denesting lugs which prevent the base portions 2 and lids 4 from becoming interlocked with one another when placed in a stack.

Figure 13:
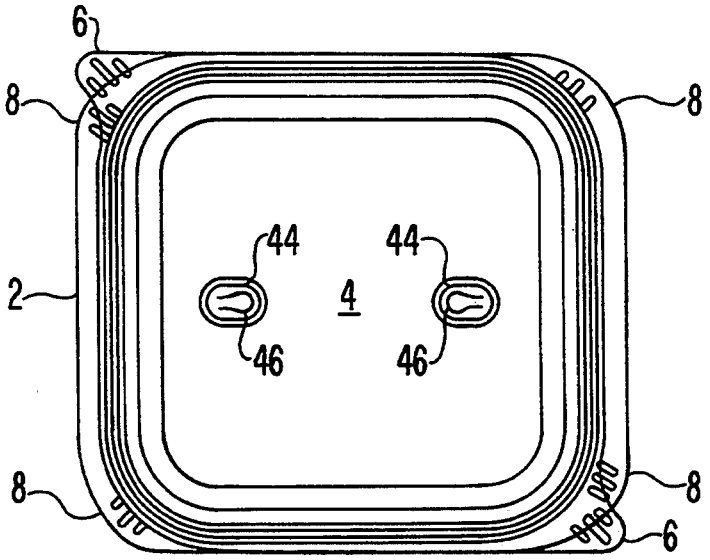
FIG. 13 is an elevated top view of a lid engaged with a base made in accordance with the present invention.

Referring now to FIG. 13, an alternative embodiment of the present invention is illustrated therein. In this embodiment, the container takes on a substantially square configuration; however, the brim portions 14 and 16 are substantially identical to those discussed hereinabove. It can be noted from FIG. 13, however, that the opening tabs 6 of the lid 4 are offset from the opening tabs 8 of the base portion 2, such that cooperating tabs 6 and 8 may be readily grasped by the consumer in order to remove the lid 4 from the base 2. It can further be noted that the reinforcing fibs aid the consumer in grasping the opening tabs 6 and 8 which also adds strength to the portions of the lid reinforcing rim 28 and the base reinforcing rim 30 adjacent the tabs when separated by the consumer.

As was discussed hereinabove, FIG. 14 illustrates the use of the lid 4 as a stand or pedestal for the base 2 when the contents of the container are to be served or consumed by the consumer. Clearly, if the contents of the container are hot, the lid 4 forms an insulating barrier between the hot food product and the surface on which the container rests. Further, the lid can be used to insulate the consumer's hands from the hot contents of the container.

Figure 15:
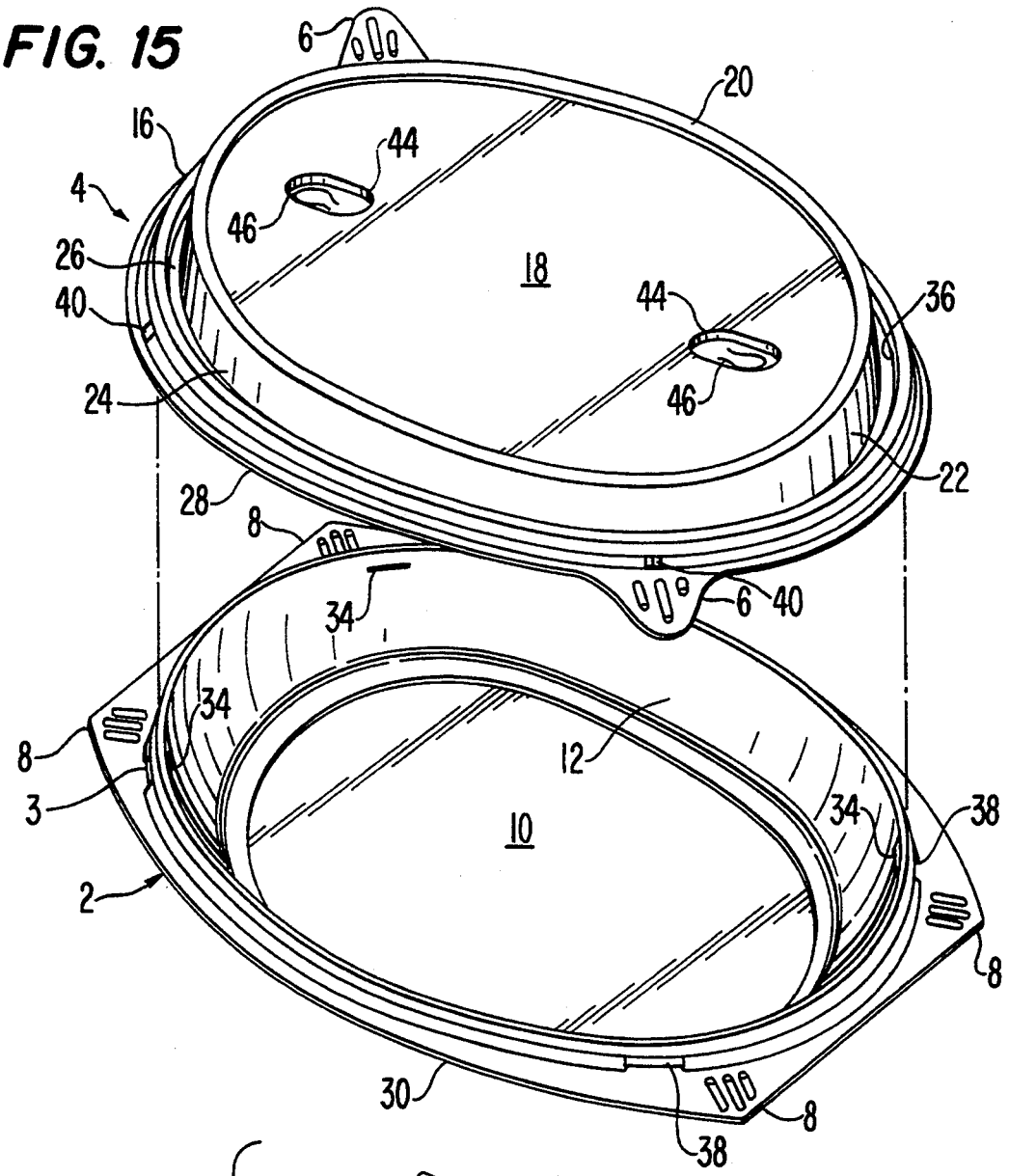
FIG. 15 is a perspective view of a second embodiment of a container made in accordance with the present invention.

In yet a further embodiment of the present invention, the container may take on an oval configuration as illustrated in FIG. 15. The critical components of both the base 2 and the lid 4 remain substantially identical to those discussed hereinabove. Further, as is clearly illustrated in FIG. 15, the undercuts 34 and 38 formed in the sealing brim 14 of the base portion 2 and the detents 36 and 40 formed in the lid 4 cooperate to form the audible sealing indicator as discussed hereinabove. More clearly illustrated in FIG. 16, these undercuts and detents are formed at approximately the same vertical height on both the lid 4 and the base 2. As is clearly illustrated in FIG. 16, the undercuts 34 are positioned to readily receive the detents 36 formed in the lid 4 and the undercuts 38 are formed to readily receive the detents 40. Again, as discussed hereinabove, these pairs of undercuts and detents are formed at the approximate corners of the container and consequently indicate when each of the several corners are in fact sealed. Moreover, the detents aid in maintaining the container in the sealed condition.

Clearly, with the foregoing container and particularly the combination of the base portion and lid portion set forth hereinabove, a container having inner and outer sealing areas which are shaped to provide a self-reinforcing seal configuration when the brim of the base portion is received within the brim of the lid portion is provided. Moreover, the initial engagement of either the inner or outer seal will urge the remaining seal into engagement and assure the alignment of the lid upon the base. Accordingly, a container having a reliable seal about a periphery thereof and preferably a dual seal thereabout is provided.

While the invention has been described with reference to preferred embodiments, it should be appreciated by those skilled in the art that the invention may be practiced, otherwise than as specifically described herein without departing from the spirit and scope of the invention. It is, therefore, to be understood that the spirit and scope of the invention be limited only by the appended claims.

What is claimed is:

1. A container including a base portion and a lid portion comprising:

(I) a unitary base comprising:

(a) a bottom;

(b) an upwardly extending peripheral wall joined to said bottom, said upwardly extending peripheral wall having an inwardly tapering frusto-conical base seal area formed therein; and (c) a downwardly and outwardly extending brim joined to said upwardly extending peripheral wall, said brim having an undercut secondary seal ridge formed therein; and (II) a unitary lid comprising:

(a) a top joined to;

(b) a downwardly extending peripheral wall to;

(c) an upwardly extending wall having a frusto-conical lid seal area formed therein, said frusto-conical lid seal area being mateable with the frusto-conical base seal area;

(d) a downwardly extending wall having a secondary seal furrow mateable with said secondary seal ridge; and (e) resilient lid realignment means located between said secondary seal furrow and said frusto-conical lid seal area for simultaneously urging said frusto-conical base seal area into close engagement with said frusto-conical lid seal area while urging said secondary seal ridge into engagement with said secondary seal furrow.

2. The container as defined in claim 1, wherein said unitary base is formed of a resilient material from a group consisting of styrenics, polyolefins, polyesters, polyamids, polyarylates, polysulfones, polyetherketones, polycarbonates, arylics, polyphenylene sulfides, liquid crystal polymers, acetals, cellulosics, polyetherimides, polyphenylene ethers/oxides, styrene maleic anhydride copolymers, styrene acrylonitrile copolymers, polyvinylchlorides, and engineered resin derivatives thereof.

3. The container as defined in claim 1, wherein said unitary lid portion is formed of a resilient material from a group consisting of styrenics, polyolefins, polyesters, polyamids, polyarylates, polysulfones, polyetherketones, polycarbonates, arylics, polyphenylene sulfides, liquid crystal polymers, acetals, cellulosics, polyetherimides, polyphenylene ethers/oxides, styrene maleic anhydride copolymers, styrene acrylonitrile copolymers, polyvinylchlorides, and engineered resin derivatives thereof.

4. The container as defined in claim 1, wherein said unitary base and said lid portion are formed by injection molding.

5. The container as defined in claim 1, wherein said unitary base and said lid portion are each thermoformed from a single planar sheet of material.

6. The container as defined in claim 1, further comprising a first upwardly extending peripheral base reinforcing hoop formed in said upwardly extending peripheral wall adjacent said frusto-conical base seal area and a second peripheral base reinforcing hoop extending downwardly from said secondary seal ridge for reinforcing said brim.

7. The container as defined in claim 6, wherein said first and second base reinforcing hoops extend outwardly.

8. The container as defined in claim 6, wherein said frusto-conical base seal area extends upwardly and inwardly from said first peripheral base reinforcing hoop.

9. The container as defined in claim 6, wherein said second base reinforcing hoop extends outwardly from said secondary seal ridge.

10. The container as defined in claim 6, further comprising an inner horizontal lid reinforcing ring extending between said downwardly extending peripheral wall and said upwardly extending wall of said lid for reinforcing said lid.

11. The container as defined in claim 6, further comprising a downwardly and outwardly flaring alignment surface extending from said secondary lid seal furrow for maintaining the structural integrity of the lid.

12. The container as defined in claim 11, further including audible seal engaging means for audibly indicating when the lid is fully engaged with the base.

13. The container as defined in claim 12, wherein said audible seat engaging means comprises first spaced depressions formed in said second base reinforcing hoop and corresponding first projections formed in said outwardly flaring lid alignment surface such that said first spaced depressions actively receive a respective one of said first projections therein.

14. The container as defined in claim 13, wherein said audible seal engaging means further includes second spaced depressions formed in the joint between said upwardly extending wall of said base and said first reinforcing hoop and opposed to said first spaced depressions, and corresponding second spaced projections formed in the joint between said inner horizontal reinforcing ring and said upwardly extending wall of said lid such that said second spaced projections actively engage said second spaced depression.

15. The container as defined in claim 1, further comprising denesting lugs formed in said unitary base.

16. The container as defined in claim 15, wherein said denesting lugs are formed in said upwardly extending peripheral wall of said base with a mutual spacing between each of said lugs being unequal.

17. The container as defined in claim 1, further comprising denesting lugs formed in said unitary lid portion.

18. The container as defined in claim 17, wherein said denesting lugs are formed in said downwardly extending peripheral wall of said lid with a mutual spacing between each of said lugs being unequal.

19. The container as defined in claim 1, further comprising substantially horizontally extending flanges extending from an outer periphery of each of said lid and said base and spaced apart radially extending finger grips extending from said flanges, wherein said finger grips of said lid are offset from said finger grips of said base when said lid is placed on said base.

20. The container as defined in claim 1, further comprising a male lid engaging portion formed on said bottom of said unitary base and a female receiving cavity formed in said unitary lid portion, wherein said female receiving cavity is shaped to receive said male lid engaging portion so that said unitary lid portion forms a stand for said unitary base.

21. The container as defined in claim 1, further comprising spaced wells having openings therein formed in said top of said unitary lid portion and projecting into an interior of the container said unitary lid portion is placed on said unitary base portion.

22. A container including a base portion and a lid portion comprising:

(I) a unitary base comprising:
(a) a substantially flat bottom;
(b) an upwardly extending peripheral wall joined to said flat bottom having formed therein;
(i) an inwardly tapering base seal; and
(ii) an upwardly and outwardly flared first base alignment surface;
(c) a downwardly and outwardly extending brim joined to said upwardly and outwardly flared first base alignment surface, said brim having formed therein;
(i) a downwardly and outwardly flared alignment surface; and
(ii) an undercut secondary seal ridge; and
(II) a unitary lid portion comprising:
(a) a substantially flat upper surface joined to
(b) a downwardly extending peripheral wall joined to
(c) an upwardly extending wall having formed therein:
(i) a downwardly and outwardly flared first lid alignment surface substantially congruent to said first base alignment surface, and
(ii) an inwardly and upwardly tapering lid seal area mateable with the base seal area and tapering inwardly at an angle closely matched to the angle at which said base seal area tapers inwardly;
(d) an outwardly and downwardly flaring wall having formed therein a secondary seal furrow mateable with said secondary seal ridge; and
(e) resilient lid realignment means located between said secondary seal furrow and said inwardly tapering lid seal area for yieldably realigning the seal furrow and the lid seal area;
said resilient lid realignment means being disposed and configured so as to constitute means for simultaneously urging said inwardly tapering base seal area into close engagement with said inwardly tapering lid seal area while urging said secondary seal ridge into engagement with said secondary seal furrow.

23. The container as defined in claim 22, wherein said unitary base is formed of a resilient material from a group consisting of styrenics, polyolefins, polyesters, polyamids, polyarylates, polysulfones, polyetherketones, polycarbonates, arylics, polyphenylene sulfides, liquid crystal polymers, acetals, cellulosics, polyetherimides, polyphenylene ethers/oxides, styrene maleic anhydride copolymers, styrene acrylonitrile copolymers, polyvinylchlorides, and engineered resin derivatives thereof.

24. The container as defined in claim 22, wherein said unitary lid portion is formed of a resilient material from a group consisting of styrenics, polyolefins, polyesters, polyamids, polyarylates, polysulfones, polyetherketones, polycarbonates, arylics, polyphenylene sulfides, liquid crystal polymers, acetals, cellulosics, polyetherimides, polyphenylene ethers/oxides, styrene maleic anhydride copolymers, styrene acrylonitrile copolymers, polyvinylchlorides, and engineered resin derivatives thereof.

25. The container as defined in claim 22, wherein said unitary base and said unitary lid portion are formed by injection molding.

26. The container as defined in claim 22, wherein said unitary base and said unitary lid portion are each thermoformed from a single planer sheet of material.

27. The container as defined in claim 22, further comprising a first upwardly extending peripheral base reinforcing hoop formed in said upwardly extending peripheral wail adjacent said inwardly tapering base seal area and a second peripheral base reinforcing hoop extending downwardly from said secondary seal ridge for reinforcing said brim.

28. The container as defined in claim 27, wherein said first and second base reinforcing hoops extends outwardly.

29. The container as defined in claim 27, wherein said inwardly tapering base seal area extends upwardly from said first peripheral base reinforcing hoop.

30. The container as defined in claim 27, wherein said second base reinforcing hoop extends outwardly from said secondary seal ridge.

31. The container as defined in claim 27, further comprising an inner horizontal lid reinforcing ring extending between said downwardly extending peripheral wall and said tapering lid seal area of said lid for reinforcing said lid.

32. The container as defined in claim 31, further including audible seal engaging means for audibly indicating when the lid is fully engaged with the base.

33. The container as defined in claim 32, wherein said audible seal engaging means comprises first spaced depressions formed in said second base reinforcing hoop and corresponding first projections formed in said outwardly flaring lid alignment surface such that said first spaced depressions actively receive a respective one of said first projections therein.

34. The container as defined in claim 33, wherein said audible seal engaging means further includes second spaced depressions formed in the joint between said upwardly extending peripheral wall of said base and said first reinforcing hoop and opposed to said first spaced depressions, and corresponding second spaced projections formed in the joint between said inner horizontal reinforcing ring and said upwardly tapering lid seal area of said lid such that said second spaced projections actively engage said second spaced depressions.

35. The container as defined in claim 22, further comprising denesting lugs formed in said unitary base.

36. The container as defined in claim 36, wherein said denesting lugs are formed in said upwardly extending peripheral wall of said base with a mutual spacing between each of said lugs being unequal.

37. The container as defined in claim 22, further comprising denesting lugs formed in said unitary lid portion.

38. The container as defined in claim 38, wherein said denesting lugs are formed in said downwardly extending flaring wall of said lid with a mutual spacing between each of said lugs being unequal.

39. The container as defined in claim 22, further comprising substantially horizontally extending flanges extending from an outer periphery of each of said lid and said base and spaced apart radially extending finger grips extending from said flanges, wherein said finger grips of said lid are offset from said finger grips of said base when said lid is placed on said base.

40. The container as defined in claim 22, further comprising a male lid engaging portion formed on said bottom of said unitary base and a female receiving cavity formed in said unitary lid portion, wherein said female receiving cavity is shaped to receive said male lid engaging portion so that said unitary lid portion forms a stand for said unitary base.

41. The container as defined in claim 22, further comprising spaced wells having openings therein formed in said top of said unitary lid portion and projecting into an interior of the container said unitary lid portion is placed on said unitary base portion.

42. The container as defined in claim 22, further comprising a resilient base realignment means positioned between said secondary seal ridge and said inwardly tapering base seal area for yieldably realigning the seal ridge and the base seal area.

43. A container including a base portion and a lid portion comprising:

(I) a unitary base comprising:

(a) a bottom;

(b) a first U-shaped peripheral section joined to said bottom, the vertical legs of said first U being generally perpendicular to the bottom, one vertical leg of said first U defining a first generally vertical peripheral wall section, said generally vertical peripheral wall having an upwardly and inwardly tapering frusto-conical base seal area formed therein; and (c) the other vertical leg of said first U defining a second generally vertical peripheral wall section, said second generally vertical peripheral wall section having an undercut secondary seal ridge formed therein; and (II) a unitary lid portion comprising:

(a) a top joined to;

(b) a second U-shaped section, mateable with said first U-shaped section, one vertical leg of said second U defining a third generally vertical peripheral wall, said third generally vertical peripheral wall having a frusto-conical lid seal area formed therein, said frusto-conical lid seal area being mateable with the frusto-conical base seal area;

(c) the other vertical leg of said second U defining a fourth generally vertical extending wall having formed therein a secondary seal furrow mateable with said secondary seal ridge; and (d) resilient lid realignment means located between said secondary seal furrow and said frusto-conical lid seal area for yieldably realigning the lid seal furrow and the lid seal area, said resilient lid realignment means being disposed and configured so as to constitute means for simultaneously urging said frusto-conical base seal area into close engagement with said frusto-conical lid seal area while urging said secondary seal ridge into engagement with said secondary seal furrow.

44. The container as defined in claim 43, wherein said unitary base is formed of a resilient material from a group consisting of styrenics, polyolefins, polyesters, polyamids, polyarylates, polysulfones, polyetherketones, polycarbonates, arylics, polyphenylene sulfides, liquid crystal polymers, acetals, cellulosics, polyetherimides, polyphenylene ethers/oxides, styrene maleic anhydride copolymers, styrene acrylonitrile copolymers, polyvinylchlorides, and engineered resin derivatives thereof.

45. The container as defined in claim 43, wherein said unitary lid portion is formed of a resilient material from a group consisting of styrenics, polyolefins, polyesters, polyamids, polyarylates, polysulfones, polyetherketones, polycarbonates, arylics, polyphenylene sulfides, liquid crystal polymers, acetals, cellulosics, polyetherimides, polyphenylene ethers/oxides, styrene maleic anhydride copolymers, styrene acrylonitrile copolymers, polyvinylchlorides, and engineered resin derivatives thereof.

46. The container as defined in claim 43, wherein said unitary base and said lid portion are formed by injection molding.

47. The container as defined in claim 43, wherein said unitary base and said lid portion are each thermoformed from a single planar sheet of material.

48. The container as defined in claim 43, further comprising denesting lugs formed in said unitary base.

49. The container as defined in claim 48, wherein said denesting lugs are formed in said first generally vertical peripheral wall section, with a mutual spacing between each of said lugs being unequal.

50. The container as defined in claim 43, further comprising denesting lugs formed in said unitary lid portion.

51. The container as defined in claim 50, wherein said denesting lugs are formed in said third generally vertical peripheral wall, with a mutual spacing between each of said lugs being unequal.

52. The container as defined in claim 43, further comprising substantially horizontally extending flanges extending from an outer periphery of each of said lid and said base and spaced apart radially extending finger grips extending from said flanges, wherein said finger grips of said lid are offset from said finger grips of said base when said lid is placed on said base.

53. The container as defined in claim 43, further comprising a male lid engaging portion formed on said bottom of said unitary base and a female receiving cavity formed in said unitary lid portion, wherein said female receiving cavity is shaped to receive said male lid engaging portion so that said unitary lid portion forms a stand for said unitary base.

54. The container as defined in claim 43, further comprising spaced wells having openings therein formed in said top of said unitary lid portion and projecting into an interior of the container said unitary lid portion is placed on said unitary base portion.

55. A container including a base portion and a lid portion comprising:

(I) a unitary base comprising:

(a) a bottom;

(b) a first U-shaped peripheral section joined to said bottom, the vertical legs of said first U being generally perpendicular to the bottom, one vertical leg of said first U defining a first generally vertical peripheral wall section, said generally vertically peripheral wall having a frusto-conical base seal area formed therein; and (c) the other vertical leg of said first U defining a second generally vertical peripheral wall section; and (II) a unitary lid portion comprising:

(a) a top joined to;

(b) a second U-shaped section, mateable with said first U-shaped section, one vertical leg of said second U defining a third generally vertical peripheral wall, said third generally vertical peripheral wall having a frusto-conical lid seal area formed therein, said frusto-conical lid seal area being mateable with the frusto-conical base seal area;

(c) the other vertical leg of said second U defining a fourth generally vertically extending peripheral wall;

(d) one of said second and fourth generally vertical peripheral walls having an undercut secondary seal ridge formed therein, the other having formed therein a secondary seal furrow mateable with said secondary seal ridge; and (e) resilient lid realignment means located between said fourth generally vertical peripheral wall and said frusto-conical lid seal area for yieldably realigning the secondary lid seal and the lid seal area, said resilient lid realignment means being disposed and configured so as to constitute means for simultaneously urging said frusto-conical base seal area into close engagement with said frusto-conical lid seal area while urging said secondary seal ridge into engagement with said secondary seal furrow.

* * * * *